US006886207B1

(12) United States Patent
Solanki

(10) Patent No.: US 6,886,207 B1
(45) Date of Patent: May 3, 2005

(54) TOOTHBRUSH

(75) Inventor: Sanjay Amratlal Solanki, Egham (GB)

(73) Assignee: The Procter & Gamble Company, Cincinnati, OH (US)

( * ) Notice: Subject to any disclaimer, the term of this patent is extended or adjusted under 35 U.S.C. 154(b) by 140 days.

(21) Appl. No.: 09/979,933

(22) PCT Filed: Jun. 9, 2000

(86) PCT No.: PCT/US00/15901

§ 371 (c)(1),
(2), (4) Date: Nov. 27, 2001

(87) PCT Pub. No.: WO00/76369

PCT Pub. Date: Dec. 21, 2000

(30) Foreign Application Priority Data

Jun. 14, 1999 (GB) ..... 9913717

(51) Int. Cl.[7] ..... A46B 9/06

(52) U.S. Cl. ..... 15/110; 15/167.1; 15/DIG. 6; 15/188; 15/207.2

(58) Field of Search ..... 601/141; 15/186–187, 15/110, 167.1, 207.2, DIG. 5, DIG. 6, 188

(56) References Cited

U.S. PATENT DOCUMENTS

| | | | | |
|---|---|---|---|---|
| 1,251,250 A | | 12/1917 | Libby | |
| 1,588,785 A | | 6/1926 | Van Sant | |
| 1,924,152 A | | 8/1933 | Coney et al. | |
| 2,139,245 A | | 12/1938 | Ogden | |
| 2,154,846 A | | 4/1939 | Heymann et al. | |
| 2,476,201 A | | 7/1949 | Ligoure | |
| 2,819,482 A | | 1/1958 | Applegate | |
| 3,007,441 A | | 11/1961 | Eyer | |
| 3,258,805 A | | 7/1966 | Rossnan | |
| 3,553,759 A | * | 1/1971 | Kramer et al. | 15/110 |
| 4,263,691 A | | 4/1981 | Pakarnseree | |
| 4,277,862 A | | 7/1981 | Weideman | |

(Continued)

FOREIGN PATENT DOCUMENTS

| | | |
|---|---|---|
| DE | 2 311 043 | 9/1974 |
| DE | 2 402 785 | 3/1979 |
| DE | 36 28 722 A1 | 2/1988 |

(Continued)

*Primary Examiner*—Terrence R. Till
*Assistant Examiner*—Shay L Balsis
(74) *Attorney, Agent, or Firm*—James C. Vago

(57) ABSTRACT

The toothbrush of the present invention comprises an elongated handle having a head attached to one end. The head has a bristle-bearing face having longitudinal perimeter portions adjacent longitudinal edges and at least two perimetric, elastomeric massaging elements alternately arranged with groups of bristle tufts along each of the longitudinal perimeter portions. The brush can comprise further massaging elements which are not located along the longitudinal perimeter portions though the use of such additional elements is preferably minimised. The perimetric massaging elements have rotational symmetry through an angle of 120° or less, preferably being circular. The cross-sectional area proportion of elastomeric massaging elements to bristles on the brush head is less than 25%. Alternately there are four or fewer elastomeric massaging elements which are not perimetric massaging elements. A brush with both bristles and gum massaging elements arranged as set out above provides both cleaning and gum massaging benefits without creating an undesirable aesthetic impression derived from the use of rubber-like materials in the part of the brush head traditionally comprising only bristles.

20 Claims, 1 Drawing Sheet

U.S. PATENT DOCUMENTS

| | | | | |
|---|---|---|---|---|
| 4,288,883 | A | 9/1981 | Dolinsky | |
| 4,585,416 | A | 4/1986 | DeNiro et al. | |
| 4,646,381 | A | 3/1987 | Weihrauch | |
| 4,749,233 | A | 6/1988 | Weihrauch | |
| 4,780,924 | A | 11/1988 | Hansen et al. | |
| 5,040,260 | A | 8/1991 | Michaels | |
| 5,054,154 | A | 10/1991 | Schiffer et al. | |
| 5,137,039 | A | 8/1992 | Klinkhammer | |
| 5,274,870 | A | 1/1994 | Stollman | |
| D345,054 | S | 3/1994 | Spence, Jr. | |
| 5,291,878 | A | 3/1994 | Lombardo et al. | |
| 5,313,909 | A | 5/1994 | Tseng et al. | |
| D350,851 | S | 9/1994 | Spence, Jr. | |
| 5,398,369 | A | 3/1995 | Heinzelman et al. | |
| 5,604,951 | A | 2/1997 | Shipp | |
| 5,628,082 | A | 5/1997 | Moskovich | |
| 5,742,972 | A | 4/1998 | Bredall et al. | |
| 5,781,958 | A | 7/1998 | Meessmann et al. | |
| 5,836,033 | A | 11/1998 | Berge | |
| 5,987,688 | A | 11/1999 | Roberts et al. | |
| 6,151,745 | A | 11/2000 | Roberts et al. | |
| 6,311,358 | B1 | 11/2001 | Soetewey et al. | |
| 6,463,618 | B1 * | 10/2002 | Zimmer | 15/110 |
| 2002/0084550 | A1 | 7/2002 | Roberts et al. | |

FOREIGN PATENT DOCUMENTS

| | | |
|---|---|---|
| EP | 0 165 546 | 12/1985 |
| EP | 0 360 766 | 3/1990 |
| EP | 0 580 406 A1 | 1/1994 |
| EP | 0 716 573 B1 | 1/1997 |
| EP | 0 708 609 B1 | 12/1998 |
| EP | 0 768 831 B1 | 11/1999 |
| EP | 0 957 707 B1 | 1/2002 |
| FR | 792 476 | 12/1935 |
| FR | 920 155 | 3/1947 |
| FR | 2 196 782 | 3/1974 |
| FR | 2 773 961 | 7/1999 |
| GB | 2 035 076 | 6/1980 |
| WO | WO 94/09678 | 5/1994 |
| WO | WO 95/06420 | 3/1995 |
| WO | WO 96/01577 | 1/1996 |
| WO | WO 96/15696 | 5/1996 |
| WO | WO 96/28994 | 9/1996 |
| WO | WO 97/03587 | 2/1997 |
| WO | WO 97/07706 | 3/1997 |
| WO | WO 97/07707 | 3/1997 |
| WO | WO 97/16995 | 5/1997 |
| WO | WO 97/20484 | 6/1997 |
| WO | WO 97/24048 | 7/1997 |
| WO | WO 97/25900 | 7/1997 |
| WO | WO 97/29663 | 8/1997 |
| WO | WO 98/03097 | 1/1998 |
| WO | WO 98/18364 | 5/1998 |
| WO | WO 98/22000 | 5/1998 |
| WO | WO 99/37181 | 7/1999 |
| WO | WO 99/37182 | 7/1999 |
| WO | WO 99/44465 | 9/1999 |
| WO | WO 00/15077 | 3/2000 |
| WO | WO 00/64307 | 11/2000 |

* cited by examiner

TOOTHBRUSH

FIELD OF THE INVENTION

The present invention relates to toothbrushes and more particularly to toothbrushes with both bristles and gum massaging elements attached to the brush head.

BACKGROUND OF THE INVENTION

Toothbrushes generally comprise bristles, usually arranged in tufts of about 40 to 50, for the purpose of cleaning teeth by removing accumulated plaque and other debris. It has further been recognised gum health can be improved by gentle stimulation of the gums with massaging elements. There has therefore been a desire to have a toothbrush which provides for the cleaning ability of bristles, along with a massaging elements also located on the toothbrush head to stimulate the gums.

U.S. Pat. No. 4,277,862 discloses a toothbrush comprising an elongate massaging element along each side of the brush head. The toothbrush of U.S. Pat. No. 4,288,883 has a wider than conventional head with a central bristle portion flanked by arrays of massaging elements. U.S. Pat. No. 5,628,082 describes a toothbrush with transverse 'bristle' bars, the description revealing that the bristle bars can also be made of a rubber-like or thermoplastic material; the brush may also have a massaging tip. A toothbrush described in EP-A-360,766 has outer longitudinal rows of resilient massaging cylinders integrally formed with a backing which covers the back face of the toothbrush and its tip. WO-A-96/15696 describes a toothbrush with strips of a flexible and resilient material, which in some embodiments are arranged in transverse rows alternated with rows of bristles. WO-A-98/18364 discloses a toothbrush with a combination of bristles, soft cleansing pad and/or polishing fingers. FIG. 4 of that application shows a brush with longitudinal outer rows comprising both polishing fingers and bristle tufts.

Nevertheless, despite the foregoing, such brushes have not met with significant commercial success. One of the reasons may be that, although gum massaging elements can provide useful therapeutic benefits, it has been found by the present applicant that brush users dislike the feeling of significant amounts of rubber in the part of the brush head generally occupied by bristles. It has, however, now further been found that the impression of rubber on the brush head can be significantly alleviated, whilst retaining the benefits of massaging elements by interspersing massaging elements with bristle tufts along the brush periphery and by avoiding the use of massaging elements in the central portion of the brush head.

SUMMARY OF THE INVENTION

The toothbrush of the present invention comprises:

a) an elongated handle having distal and proximal ends;

b) a head attached to the proximal end of the handle, the head including a bristle-bearing face with bristles attached thereto and a back face opposed to the bristle-bearing face;

c) opposed longitudinal edges bounding the bristle-bearing and back faces, the bristle bearing face having longitudinal perimeter portions adjacent the longitudinal edges; and d) at least two perimetric, elastomeric massaging elements alternately arranged with groups of bristle tufts along each of the longitudinal perimeter portions.

Although the brush can comprise further massaging elements which are not located along the longitudinal perimeter portions, such as at the tip or along a central longitudinal axis of the bristle-bearing face, the use of such additional elements is preferably minimised. Further, it is preferred that the perimetric massaging elements have substantially equal bending moments in both longitudinal and transverse directions. Accordingly, the perimetric massaging elements have rotational symmetry through an angle of 120° or less, preferably being circular. Further, the cross-sectional area proportion of all bristles and elastomeric massaging elements afforded by elastomeric massaging elements is less than 25%. Alternately there are four or fewer elastomeric massaging elements which are not perimetric massaging elements.

A brush with both bristles and gum massaging elements arranged as set out above provides both cleaning and gum massaging benefits without creating an undesirable aesthetic impression derived from the use of rubber-like materials in the part of the brush head traditionally comprising only bristles.

DETAILED DESCRIPTION OF THE INVENTION

The toothbrush of the invention has an overall conventional construction, by which is meant that it comprises a generally elongated handle with a brush head attached to one end of the handle. The head can be detachably connected to the handle, for example to permit replacement of the head when bristles become worn. Herein the end of the handle to which the head is attached shall be referred to as the proximal end and the opposite end the distal end. The construction of the handle is not critical to the present invention. The handle should of course be comfortable to grip and allow easy manipulation of the brush so that the head can be moved around the various areas of the mouth. Preferably it will include elastomeric grip portions moulded to the rigid portion of the handle, as is now almost customary with toothbrush design. The handle can comprise a neck region at its proximal end, the neck being a portion of the handle which is generally of smaller cross-section than the rest of the handle and is usually devoid of grip elements.

The head too is of generally elongated shape with its long axis (a longitudinal axis) being aligned with that of the handle. The head is of generally flattened construction, having a bristle-bearing face with bristles and massaging elements attached thereto and a back face opposed to the bristle-bearing face. The head also has a transverse axis lying orthogonal to the longitudinal axis and generally parallel to the opposed faces. References to transverse or longitudinal herein refer to directions which are respectively parallel to these transverse and longitudinal axes, unless indicated otherwise. The head has a tip at the end remote from the handle. The tip may be co-planar with the rest of the head or, preferably, it can be angled upwards in relation to it (where upwards means in the direction of the bristles) in order to accentuate the effect of a molar cleaning tip without needing to provide longer bristles. If the tip is angled upwards then it is generally at an angle of from about 10° to about 20°, preferably from about 13° to about 18° to the rest of the head. Opposed longitudinal edges bound the bristle-bearing and back faces. The edges are coterminous with the handle and converge at the tip of the toothbrush head. The bristle bearing face has longitudinal perimeter portions adjacent the longitudinal edges. The longitudinal edges need not necessarily be straight or parallel to the longitudinal axis of the brush head. Typically they will be gently curved so that a plan view of the head is generally in the shape of an elongated oval.

The bulk of the head and handle are generally made of relatively non-compressible materials, preferably with a modulus of elasticity of at least about 500 MPa, more preferably at least about 1000 MPa, which are conventional in the manufacture of toothbrushes, especially plastics materials. Suitable plastics materials include, for example, polyamides and polypropylenes. Polypropylene is preferred. Suitable polypropylenes include 'Polypropylene PM 1600' (marketed by Shell), having a modulus of elasticity (ISO 178) of 1500 MPa and Apryl 3400 MA1 from Elf Atochem.

The head, excluding bristles and massaging elements, can be of single construction or it can be multi-segmented as set out in WO-A-98/27846, incorporated herein by reference. Preferably it is of single construction. In an alternately preferred embodiment however the head has a handle end and a free end and the head comprises a first head segment which is connected to or continuous with the handle and one or more additional head segments arranged in longitudinal sequence towards the free end of the head, the head segments being connected to each other by a connecting means consisting essentially of an elastomer. Such arrangements are described in more detail in WO-A-98/27846.

The head and handle are typically made by injection moulding. Bristles and massaging elements can be attached by art-known methods such as stapling and anchorless manufacturing technologies.

The bristle-bearing face of the head has both bristles and massaging elements attached thereto. The bristles and massaging elements have head ends, where they are attached to the head and free ends which provide the brushing/massaging surface of the brush. They are elongate between the head and free ends and have a long axis along the elongated direction. The bristles are generally arranged in tufts which project generally perpendicularly from the bristle-bearing face, although some tufts may lie at an angle of up to 40° from the perpendicular. The tufts typically contain from about 30 to about 100 or more bristles and generally have a uniform cross-section along their length in a plane parallel to the bristle-bearing face, such as would be provided by commercially available extruded bristle materials. Although the bristles are preferably straight, other configurations, such as crimped, may also be used. Some or all bristle tufts may also have flagged ends to further promote gum massage and/or improve cleaning in small gaps. The cross-section is typically round, oval or polygonal, such as triangular or rectangular. There can be an enlarged tuft of bristles at the tip of the brush. This tip tuft can be three to four times the size of other tufts, having a cross-sectional are in the range from about 5 to about 20, preferably from about 7 to about 12 $mm^2$. Such tip tufts typically project further outwardly than the other bristle tufts with the express purpose of penetrating behind rear molars. This can be achieved by providing the tip tuft with longer bristles than other tufts. Preferably it is at least partly achieved by angling the tip of the head as described above. This enables the bristles of the tip tuft to be kept shorter and hence firmer than would otherwise be the case. The tip tuft may also be angled forwards, away from the remaining tufts at an angle of up to 10°, preferably at an angle of 5 to 10° to a perpendicular to the bristle-bearing face. The total number of tufts is generally in the range from about 20 to about 50. The bristles typically have a length from about 5 to about 15 mm, preferably from about 8 to about 12 mm measured from the bristle-bearing face to the free ends of the bristles. The bristles can all be of the same length to provide an essentially flat brushing surface, or they can be cut to different lengths such that the free ends form a 3-D surface, for example a sinusoidal surface.

It is an essential feature of the present invention that the brush comprises at least two perimetric, elastomeric massaging elements alternately arranged with groups of bristle tufts along each of the longitudinal perimeter portions. Perimetric, elastomeric massaging elements are arranged along each of the longitudinal perimeter portions such that there are no other tufts or massaging elements which are more than 1 mm closer to the longitudinal edges of the brush head. It is these tufts that provide the important gum massaging benefits. The perimetric, elastomeric massaging elements are preferably made of a thermoplastic elastomer having a hardness from about 10 to about 60 Shore A, more preferably from about 20 to about 50 Shore A and most preferably about 40 Shore A. Suitable materials include those available under the tradenames Megol and Santoprene. Silicone elastomers are also useful.

The massaging elements have lengths which are in the same range as those described above for bristles. Also, like the bristle tufts, they generally have a uniform cross-section along their length. However, to assist in moulding they preferably taper towards their free ends along their entire length with an angle of taper typically in the range from about 1 to about 2°.

In order that the perimetric massaging elements have substantially similar bending moments in both longitudinal and transverse directions the perimetric massaging elements have rotational symmetry through an angle of 120° or less, more preferably 90° or less. By this is meant that when a perimetric massaging element is rotated about its long axis, after a rotation of 120° or less its cross-section will substantially overlay the original cross-section. Preferred cross-sectional shapes are selected from circular and regular polygonal, such as triangular, square or octagonal. Most preferably they are of circular cross-section. Elongated rectangular cross-sections will not meet the criterion of rotational symmetry since a rotation of 180° is necessary to reproduce the same shape. Such shapes, aligned to either the transverse or longitudinal axes have substantially different bending modes in the transverse and longitudinal directions. It will be appreciated however, that where the dimensions of a rectangle are closely similar, say within 20% or less, more so for 10% or less, much the same behaviour will be obtained as for a square shape. Preferably the free ends of the massaging elements are rounded, say for the final 1 to 2 mm of the element, of a diameter less than that of the main part of the element. The largest measurement (the thickness) of the perimetric massaging elements in cross-section is preferably from about 1 to about 3 mm, more preferably from about 1.5 to about 2.5 mm.

There are at least two, preferably at least three, more preferably at least four and optimally five perimetric massaging elements along each longitudinal perimeter portion of the brush head. In preferred embodiments single massaging elements alternate with single bristle tufts along the perimeter portions such that there is one bristle tuft between each pair of longitudinally adjacent perimetric massaging elements. The perimetric massaging elements can be grouped in pairs for example, though in such cases it is preferred that there be at least two sets along each edge of the brush with tufts in between each set.

In preferred embodiments the pattern of bristle tufts and massaging elements on the bristle-bearing face is symmetrical about the longitudinal axis of the head, so that perimetric massaging elements are arranged in pairs at either end of transverse axes of the head. Preferably also, in side view the tips of perimetric massaging elements and perimetric bristle tufts form an arc which has its highest point above the centre of the brush head and is lower at the handle and free ends of the head.

The brush can comprise massaging elements in addition to the perimetric massaging elements. These can be of similar size and shape to the perimetric massaging elements and can be located at the brush tip or in the central area of the brush located between the longitudinal perimeter portions, such as on the longitudinal axis of the head. Preferably however the number of such additional massaging elements is kept to four or less, preferably two or less. More preferably there are none so that the perimetric massaging elements are the only elastomeric massaging elements. In this way the 'rubbery' impression of the head is reduced. Suitably, the cross-sectional area proportion of all bristles and elastomeric massaging elements afforded by elastomeric massaging elements is less than 25%, preferably less than 15%. By "cross-sectional are proportion . . . afforded by elastomeric massaging elements" is meant the fraction of the sum of all cross sectional areas of bristle tufts and massaging elements that is represented by massaging elements alone. For example, if the cross-sectional area of bristle tufts and massaging elements total 160 $mm^2$ and the cross-sectional areas of massaging elements alone total 20 $mm^2$ then the cross-sectional area proportion afforded by elastomeric massaging elements is 12.5%. For the avoidance of doubt, when considering bristle tufts, it is the total area of the tuft that is measured including any inter-bristle spaces within the tuft that arise from imperfect packing. All areas are measured at the bases of the tufts and massaging elements i.e. at the plane of the bristle-bearing face.

The perimetric massaging elements are preferably incorporated into the brush head by injection moulding. More preferably they are integrally moulded with elastomeric support elements which extend transversely across the back face of the toothbrush head. In the segmented brush heads referred to above these elastomeric support elements can be the connecting means between segments. Alternatively, and preferably, there can be a single elastomeric support element which is an elastomeric sheet which covers substantially all of the back of the head. In such an embodiment there is preferably no elastomer covering the tip of the brush head.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE DRAWINGS

Figure 1:
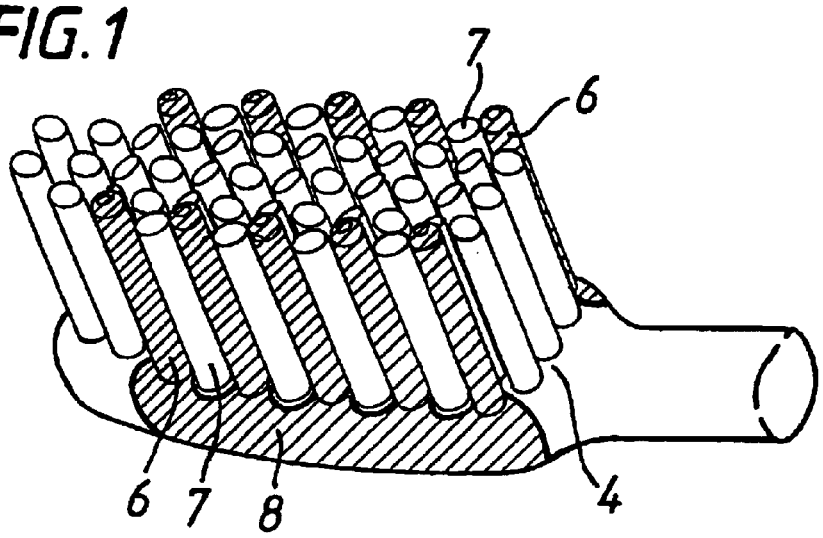
FIG. 1 is a perspective view of an embodiment of a toothbrush head of the present invention. For simplicity the handle is not shown in full. The massaging elements are shaded.
Figure 2:
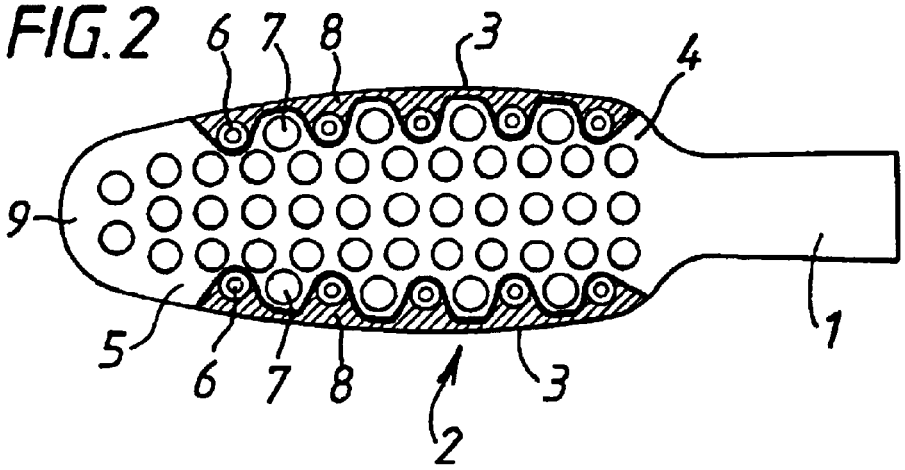
FIG. 2 is a plan view of the head of FIG. 1 showing the pattern of tufts and massaging elements. Massaging elements are shown with a small inner circle concentric with the element outline.
Figure 3:
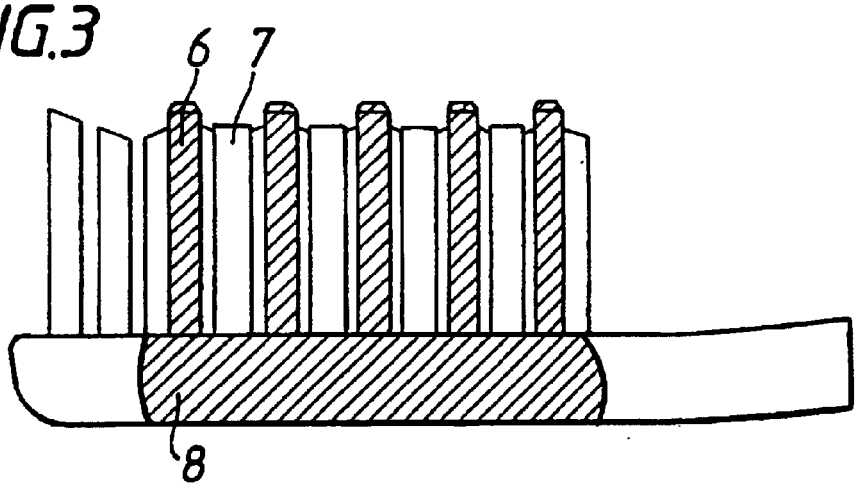
FIG. 3 is a side view of the head of FIG. 1.

Referring now to the drawings in detail wherein like numerals indicate the same element throughout the views there is shown in FIGS. 1, 2 and 3 an embodiment of the present invention which comprises outer longitudinal rows of perimetric massaging elements 6 and bristle tufts 7 extending upwardly from the bristle-bearing face 4 of head 2. The outer longitudinal rows are located on longitudinal perimeter portions 5 of the head. There is one bristle tuft 7 between each pair of adjacent perimetric massaging elements 6. The head is attached to handle 1, though the handle is not shown in full, it not being critical to the invention. The perimetric massaging elements 6 are integrally moulded with an elastomeric sheet 8 which wraps around the sides and back, but not the tip, of the head. The entire head 2 is moulded via a first step in which a skeleton is formed from polypropylene, simultaneously embedding bristle tufts 7, the elastomer of the massaging elements and support sheet being bonded to the skeleton in a second injection moulding step. Finally The perimetric massaging elements are circular in cross-section but taper very slightly towards their free ends. The longitudinal edges 3 of the polypropylene skeleton of the head are indented to provide points of anchorage for the elastomer. This can best be understood from the plan view of FIG. 2. When the elastomer has been moulded on, the longitudinal edges have a smooth curve.

In this embodiment the tip 9 of the brush is coplanar with the rest of the head. In more preferred embodiments however the tip is angled upwards as described further above.

What is claimed is:

1. A toothbrush having a proximal free end and a distal free end furthest from the proximal free end, comprising:

a skeleton comprising an elongated handle and a head attached to said elongated handle which terminates at the distal free end of the toothbrush, said head having a pair of sides, a top face having a plurality of bristle tufts disposed therein, and a back face opposed to said bristle-bearing face, wherein one of said plurality of bristle tufts is disposed at the distal free end of the toothbrush;

a pair of elastomeric support elements molded to a portion of said sides of said head and a plurality of perimetric elastomeric massaging elements integrally formed with each of said elastomeric support elements, said perimetric elastomeric massaging elements extending upward from each of said elastomeric support elements; and wherein said elastomeric support elements cover a portion of said sides of said head and a portion of said back face of said head and wherein said head has a plurality of indentations which extend through said head from said top face to said back face and which facilitate securing said elastomeric support elements to said head and wherein said indentations are scallop-shaped.

2. The toothbrush according to claim 1, wherein said elastomeric support elements form a sheet which covers substantially all of said back face of said head.

3. The toothbrush of claim 1, wherein said plurality of indentations comprises a distinct indentation for each of said perimetric elastomeric massaging elements.

4. The toothbrush of claim 1, wherein said perimetric elastomeric massaging elements along each of said sides of said head are arranged in only a single row.

5. A toothbrush, comprising:

a skeleton comprising an elongated handle and a head attached to said elongated handle, said head having a pair of sides, a top face and a back face opposed to said top face;

a pair of elastomeric support elements molded to a portion of said sides of said head, and at least three perimetric elastomeric massaging elements integrally formed with each of said elastomeric support elements, said at least three perimetric elastomeric massaging elements extending individually upward from each of said elastomeric support elements; and wherein each of said sides of said head have a plurality of indentations which facilitate securing said elastomeric support elements to said head and wherein a perimetric bristle tuft is disposed between adjacent indentations along said sides of said head and wherein said indentations are scallop-shaped.

6. The toothbrush of claim 5, wherein said indentations extend through said head from said top face to said back face.

7. The toothbrush of claim 5, wherein said plurality of indentations comprises a distinct indentation for each of said perimetric elastomeric massaging elements.

8. The toothbrush of claim 5, wherein said elastomeric support elements form a sheet which covers substantially all of said back face of said head.

9. The toothbrush of claim 5, wherein said perimetric elastomeric massaging elements along each of said sides of said head are arranged in only a single row.

10. A toothbrush having a proximal fee end and a distal free end furthest from the proximal free end, comprising:

a skeleton comprising an elongated handle and a head attached to said elongated handle which terminates at the distal free end of the toothbrush, said head having a pair of sides, a top face having a plurality of bristle tufts disposed therein, and a back face opposed to said bristle-bearing face, wherein one of said plurality of bristle tufts is disposed at the distal free end of the toothbrush;

a pair of elastomeric support elements molded to a portion of said sides of said head and a plurality perimetric elastomeric massaging elements integrally formed with each of said elastomeric support elements, said plurality of perimetric elastomeric massaging elements extending upward from each of said elastomeric support elements; and wherein said elastomeric support elements cover a portion of said sides of said head and a portion of said back face of said head and wherein said head has a plurality of indentations which extend through said head from said top face to said back face and which facilitate securing said elastomeric support elements to said head and wherein said plurality of indentations comprises a distinct indentation for each of said perimetric elastomeric massaging elements.

11. The toothbrush according to claim 10, wherein said elastomeric support elements form a sheet which covers substantially all of said back face of said head.

12. The toothbrush according to claim 10, wherein said indentations are scallop-shaped.

13. The toothbrush of claim 10, wherein said perimetric elastomeric massaging elements along each of said sides of said head are arranged in only a single row.

14. A toothbrush, comprising:

a skeleton comprising an elongated handle and a head attached to said elongated handle, said head having a pair of sides, a top face and a back face opposed to said top face, wherein each of said sides have a plurality of longitudinally adjacent indentations and at least one outwardly extending extension formed between said plurality of longintudinally adjacent indentations;

a pair of elastomeric support elements molded to a portion of said sides of said head;

a perimetric elastomeric massaging element integrally formed with each of said elastomeric support elements, said perimetric elastomeric massaging element extending upward from each of said elastomeric support elements.

15. The toothbrush according to claim 14, further comprising a perimetric bristle tuft disposed within each of said extensions of said head of said skeleton.

16. The toothbrush according to claim 14, wherein said indentations are scallop-shaped.

17. The toothbrush according to claim 14, wherein said elastomeric support elements form a sheet which covers substantially all of said back face of said head.

18. The toothbrush according to claim 14, further comprising at least two pairs of perimetric elastomeric massaging elements, wherein said perimetric bristle tuft is disposed between said pairs of said perimetric elastomeric massaging elements.

19. The toothbrush according to claim 14, wherein each side comprises between three and five indentations.

20. The toothbrush according to claim 14, wherein each side comprises between two and four extensions.

* * * * *